United States Patent [19]

Hakoi

[11] 4,295,570

[45] Oct. 20, 1981

[54] AUTOMATIC SELECTION AND DELIVERY APPARATUS OF ASSEMBLED MECHANICAL PARTS

[75] Inventor: Tsutomu Hakoi, Kurobe, Japan

[73] Assignee: Yoshida Kogyo K.K., Tokyo, Japan

[21] Appl. No.: 105,939

[22] Filed: Dec. 21, 1979

[30] Foreign Application Priority Data

Dec. 26, 1978 [JP] Japan ..... 53-161534

[51] Int. Cl.[3] ..... B07C 9/00

[52] U.S. Cl. ..... 209/657; 209/658; 209/940

[58] Field of Search ..... 209/940, 657, 658, 688, 209/659, 615, 616, 598; 198/398; 29/407, 705

[56] References Cited

U.S. PATENT DOCUMENTS 1,421,715 7/1922 Puc ..... 209/688

2,378,711 6/1945 Kuehlman ..... 209/659

2,410,037 10/1946 Abbott ..... 209/657

*Primary Examiner*—Allen N. Knowles

*Attorney, Agent, or Firm*—Hill, Van Santen, Steadman, Chiara & Simpson

[57] ABSTRACT

Disclosed is an automatic selection and delivery apparatus adapted to discriminate between correctly and incorrectly assembled bodies consisting of a plurality of assembled parts and at the same time deliver to a delivery chute only those bodies which have been assembled correctly. This is accomplished through a detection operation performed by a delivery arm which scans recesses that are provided in a base to accommodate the assembled bodies, the delivery arm being adapted to detect a projection which will exist only on a correctly assembled body.

6 Claims, 7 Drawing Figures

AUTOMATIC SELECTION AND DELIVERY APPARATUS OF ASSEMBLED MECHANICAL PARTS

FIELD OF THE INVENTION

This invention relates to an apparatus for delivering automatically from a prescribed position an assembled body, composed of a plurality of assembled mechanical elements, upon automatically selecting between assembled bodies which have and have not been correctly assembled.

The automatic selection and delivery practiced in the present invention is performed by detecting the absence or presence of a specific projection which an assembled body must possess if the body has been assembled correctly.

CROSS-REFERENCE TO OTHER APPLICATION

In U.S. Patent Application No. 106,042 filed separately under the same date as that of the application of the present invention, the present inventor discloses an automatic selection and delivery apparatus which automatically delivers assembled bodies upon automatically selecting between assembled bodies which have and have not been correctly assembled, this being accomplished, in contradistinction to the present invention, by detecting the absence or presence of a specific through-hole which an assembled body must possess if the body has been assembled correctly.

BRIEF SUMMARY OF THE INVENTION

It is a general object of the present invention to provide an automatic selection and delivery apparatus which has a comparatively simple structure but which combines the twin functions of selection and delivery applied to assembled bodies, this being accomplished by utilizing an automatic delivery operation in selecting among bodies which have and have not been assembled correctly.

A more specific object of the present invention is to provide an automatic selection and delivery apparatus adapted to detect, by means of a swinging delivery arm, the absence or presence of a projection which an assembled body must possess if it has been assembled correctly, this absence or presence of the projection serving as a standard for discriminating between bodies assembled satisfactorily and those which have been assembled incorrectly, and also to guide to a prescribed delivery path, simultaneously the detection of the specific projection, by the swinging motion of the delivery arm, a correctly assembled body as indicated by the presence of the specific projection.

Other objects, effects and features of the present invention will be apparent from the following description of a preferred embodiment taken in conjunction with the following drawings.

DETAILED DESCRIPTION OF THE PREFERRED EMBODIMENT

Figure 1:
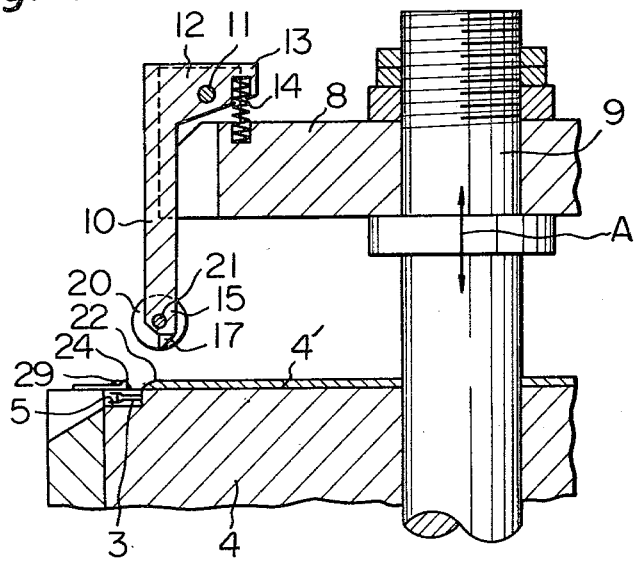
FIG. 1 is a longitudinal sectional view showing an essential portion of an embodiment of the present invention.
Figure 2:
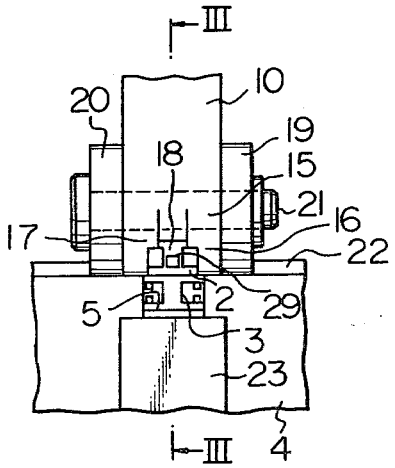
FIG. 2 is a front view of the embodiment of FIG. 1, shown at the time of a delivery operation.
Figure 3:
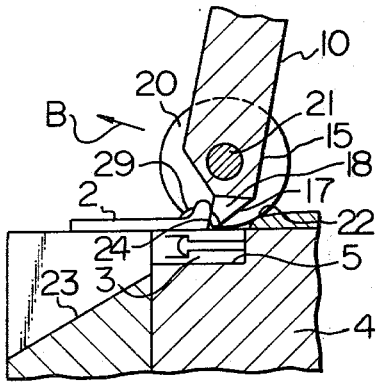
FIG. 3 is a sectional view of FIG. 2 taken along the line III—III.
Figure 4:
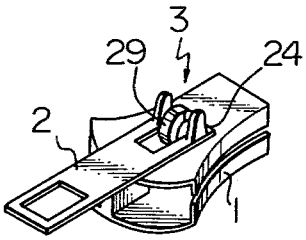
FIG. 4 is a perspective view of a slider as one example of an assembled body.

Illustrated in FIGS. 1 through 3 is an embodiment for a case in which the automatic selection and delivery apparatus of the present invention is applied to equipment used in the manufacture of sliders for slide fasteners. A completed slider 3 is shown in FIG. 4 and comprises a pull tab 2 attached to a slider body 1. In the present embodiment the slider is treated as the assembled body subjected to the selection and delivery process described above. Accordingly, a slider body to which the pull tab 2 has not been attached must be selected as an imperfectly assembled body and rejected from those bodies which have been assembled correctly.

The apparatus of the present embodiment includes a disk-shaped base 4 arranged so as to be rotated step-wise at a fixed angular pitch, the outer edge of the upper surface of the base 4 being provided with a plurality of equally spaced apart recesses 5,7 . . . for receiving parts. Various pieces of equipment are arranged about the base 4 at positions corresponding to the recesses 5 when the base is at rest, such equipment including element supply means for providing the elements that constitute the slider body, element finishing means, means for supplying a pull tab 2 to a finished slider body, means for caulking the portion at which the pull tab is attached, and automatic delivery means. In accordance with such an arrangement, slider body elements accommodated in respective ones of the recesses 5,7 are shifted from one machining stage to the next to undergo successive machining processes each time the disk-shaped base 4 is indexed or rotated by the fixed angular pitch, a completed slider being obtained at the final stage where the pull tab is caulked to the slider body. However, there are occasions where a malfunction in the pull tab supply means or pull tab caulking means can prevent a pull tab from being attached to a slider body, with the result that a slider to which a pull tab has not been attached manages to be indexed to the position of the delivery path.

The automatic selection and delivery apparatus of the present invention is adapted to deliver a correctly assembled slider by means of a delivery arm 10 which delivers the slider only when it has been correctly assembled, after discriminating between sliders which have or have not been assembled correctly, the delivery arm operating to deliver the slider which is accommodated in a recess located at the position of the automatic delivery means. A bracket 8 adapted to be moved toward or retracted from the upper surface 4' of the base 4, this direction of movement corresponding to the vertical direction in the illustrated example, is disposed above a position which will come to be occupied by each recess 5,7 . . . in succession whenever the disk-shaped base 4 comes to a stop. In the drawings the bracket 8 is shown fixedly secured to a drive shaft 9 moved up and down in the direction indicated by the arrow A by means of a driving source which is not illustrated.

The delivery arm 10 which extends down toward the base 4 is pivotally secured for swinging motion to the bracket 8 through a shaft 11. The delivery arm 10 has an inverted L-shaped configuration as viewed from the side thereof, and is pivotally secured at the center of its horizontal leg 12 via the shaft 11. Disposed between the edge 13 of the horizontal leg and the upper surface of bracket 8 is a compressed spring 14 that biases the delivery arm 10 toward the side of the drive shaft 9 and thus holds the delivery arm in abutting contact with the bracket 8 at all times.

The end 15 forming the lower extremity of the delivery arm 10 branches into a forked portion having finger members 16, 17 defining a gap 18 therebetween. Attached outside of the finger member 16, 17 via a shaft 21 passed through the delivery arm are freely rotatable rollers 19, 20 each of which is positioned so that its circumference projects slightly below the lower end of each finger member 16, 17. The circumferential surface of each roller 19, 20 forms a guiding surface at such time that the delivery arm 10 is caused to swing, as will subsequently be described.

The upper surface 4' of the base 4 is formed to include a surface which slants downwardly away from the base proper. The inclined surface, serving as a guiding surface 22, is formed at a position immediately below the delivery arm 10 vertically oriented by the spring 14. When the delivery arm 10 is lowered to bring the circumferential surfaces of the rollers 19, 20 into contact with the guiding surface 22, the latter acts to swing the delivery arm 10 in a direction indicated by the arrow B against the force exerted by the spring 14.

It is arranged so that the up and down stroke of the drive shaft 9 in the direction A covers a distance between a position, shown in FIG. 1, where the end of the delivery arm 10 clears the upper surface 4' of the base 4, and a position, shown in FIG. 3, where the end of the delivery arm can be guided by the guiding surface 22 and caused to swing in the direction B.

When the base 4 is at rest, one of its recesses 5,7 . . . is located in the path described by the end 15 of the delivery arm 10 as it is swung in the direction B. Positioned at this point is a delivery chute 23 on the frame directed downwardly away from the swinging direction B and in communication with the particular recess which has been brought into position by the base 4.

Meanwhile, the finger members 16, 17 of the delivery arm 10 are disposed at a position which permits the path of their swinging motion to be penetrated by shoulder portions 24 formed on the pull tab 2 projecting above the upper surface of the slider 3 which in the present case is the completely assembled body being accommodated in the recesses 5, 7 . . . . More specifically, each shoulder portion 24 defines a projecting portion selected from among a number of members projecting from the upper surface of the slider 3 comprising the completely assembled body.

Let it now be assumed that a correctly assembled slider, as shown in FIG. 4, has been properly received in the recess 5, and that the base 4 has been stopped at a point where the recess 5 is immediately below the delivery arm 10, as shown in FIG. 1. The drive shaft 9 begins descending upon the issuance of a command signal from a drive control unit which is not shown, and the circumferential surfaces of rollers 19, 20 at the end 15 of the delivery arm 10 come into contact with the guiding surface 22 on the side of the base 4. As the drive shaft 9, and hence the delivery arm 10, continues to descend, the end 15 of the delivery arm 10 having the finger members 16, 17 begins to be swung in the direction B. Since the projecting portion described above, namely the shoulder portion 24 of the pull tab 2 on the slider 3, projects into the path defined by the swinging motion of the finger members 16, 17, the shoulder portion 24 is struck by the finger members in the course of their swinging motion and is pushed in the direction B. The slider 3 is therefore pushed out of the recess 5 and into the delivery chute 23, and then slides down along the chute to complete the delivery operation. Following delivery the drive shaft 9 and delivery arm 10 are raised again to the position shown in FIG. 1 where they wait until the base 4 indexes the next slider-accommodating recess to the position immediately below the delivery arm.

Let it now be assumed that the recess 5 has received a slider which is unsatisfactory because the pull tab 2 has not been attached to the slider body 1 for some unknown reason. In accordance with the embodiment as illustrated in FIGS. 1 through 3, the finger members 16, 17 at the tip of the delivery arm 10 cannot in the course of swinging bring any pressure to bear against the slider 3 since the slider, representing an assembled body, does not possess the selected projecting portion or shoulder portion 24 which is formed on the pull tab 2. The unsatisfactory slider therefore remains in the recess.

Rejection of this unsatisfactory slider in the next step can be accomplished as follows. Namely, an automatic delivery apparatus similar in construction to the one illustrated in FIGS. 1 through 3 is provided adjacent thereto one step further in the direction the disk-shaped base 4 is advanced. This second automatic delivery apparatus then need only be adapted so that the finger members at the end of its delivery arm swing to describe a path that will pass the position of another projecting portion especially provided on the slider body. Such a projecting portion, for example a pull tab mounting frame 29, is always provided on the slider body and is detected by the additionally provided automatic delivery apparatus.

Figure 5:
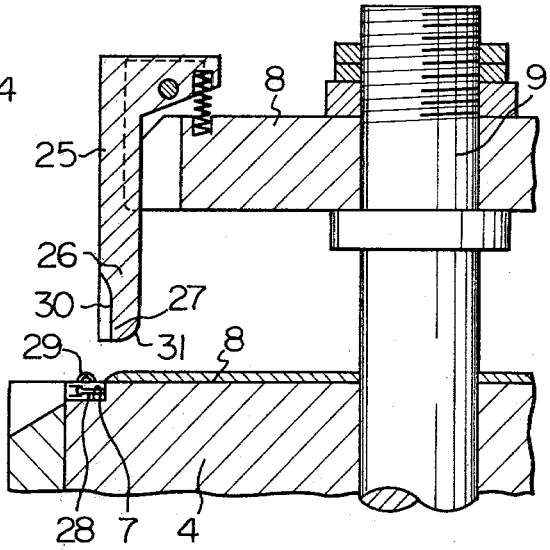
FIG. 5 is a longitudinal view showing another embodiment of the present invention.
Figure 6:
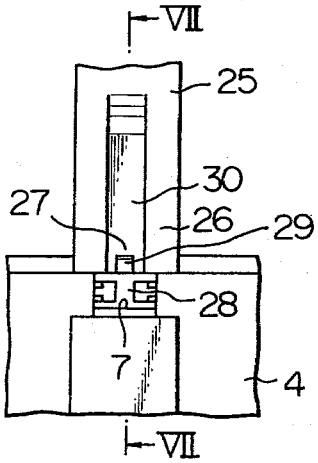
FIG. 6 is a front view of the embodiment of FIG. 5, shown at the time of a delivery operation.
Figure 7:
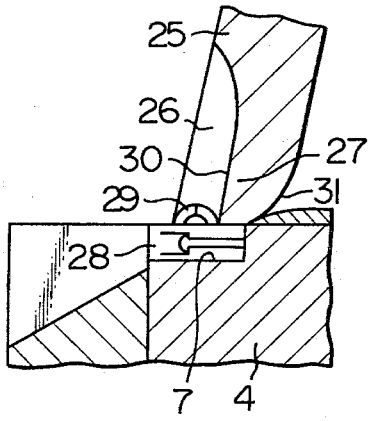
FIG. 7 is a sectional view of FIG. 6 taken along the line VII—VII.

Illustrated in FIGS. 5, 6 and 7 is another embodiment of an apparatus for automatically delivering, i.e., rejecting, the unsatisfactory slider described above. The arrangement shown here is identical to that illustrated in FIGS. 1 through 3 except for the configuration of a finger member 27 at the end 26 of a delivery arm 25.

In the present arrangement the pull tab mounting frame 29 is chosen as the projecting portion on the upper surface of the unsatisfactory slider 28. The finger member 27 is configured so that the path described by its swinging motion will be penetrated by the pull tab mounting frame 29. More specifically, while the delivery arm 10 shown in FIGS. 1 through 3 includes a gap 18 formed between the finger members 16, 17 so as to permit the pull tab mounting frame 29 to avoid the path described by these finger members, the end 26 of the present delivery arm 25 is formed to include a vertical groove 30 which is penetrated by the pull tab mounting frame 29. However, the bottom of the groove 30 at the lower extremity of the end 26 is formed as a continuous back wall. In addition, the end 26 has a broad face at its lower extremity so that the rollers 19, 20 can be omitted, while the back of the end 26 is provided with a rounded surface 31 serving as a guiding surface for the delivery arm 25. Thus with this arrangement an unsatisfactory slider 28, which has therefore not been delivered by the automatic delivery apparatus of FIGS. 1 through 3, is instead delivered automatically, i.e., rejected, by the apparatus of FIGS. 5 through 7 in exactly the same manner as described in conjunction with the previous Figures.

While the present invention has been described with regard to an embodiment in which the invention is applied to an apparatus for manufacturing sliders used in the production of slide fasteners, it should be understood that bodies composed of assembled parts can be selected and delivered automatically irrespective of the kind of assembled body as long as it is one which has a projection on its upper surface. Moreover, it is obvious that a variety of structural modifications can be made provided that there is no deviation from the objects and effects of the invention.

The apparatus of the present invention having the structure and operating in the manner described above enables bodies of assembled parts to be selected and delivered automatically and simultaneously mereby by causing a bracket axially supporting a delivery arm to advance toward and retract from a base. This makes possible a major simplification in the associated drive mechanism. Since the selection and delivery operation is effected by swinging motion of the delivery arm, correctly assembled bodies can readily be discriminated from incorrectly assembled ones by providing a finger portion at the end of the delivery arm with a suitable shape which will depend upon whether it is to be used for identifying a correctly or incorrectly assembled body and which will conform to an assembled body projection which is made to enter the path of swinging motion traced by the finger portion at the end of the delivery arm.

What is claimed is:

1. An automatic selection and delivery apparatus for assembled mechanical parts which comprises:

a base having at least one recess for receiving an assembled body the correctness of which is to be detected;

a first delivery arm having an end which includes a portion for engaging a projection which will exist on a correctly assembled body but not on an incorrectly assembled body;

said end being made to move over said base along said recess, said base having a disk-shaped configuration and provided about its circumference with a plurality of recesses spaced apart at a fixed angular pitch for receiving assembled bodies, said base being rotated step-wise by said fixed angular pitch, and said first delivery arm being driven radially of said disk-shaped base along one of said recesses in said base whenever said base comes to a stop.

2. An automatic selection and delivery apparatus according to claim 1, in which said base has an inclined surface directed radially thereof at the periphery of said plurality of recesses; and further including a bracket reciprocated vertically to advance toward and retract from said base when said base comes to a stop; said first delivery arm being pivotally secured to said bracket so as to swing in a predetermined plane, wherein the end of said first delivery arm is swung under the guidance of said inclined surface on said disk-shaped base as said bracket is advanced, whereby detections of the correctness of the assembled bodies accommodated in said recesses and the delivery of correctly assembled bodies are carried out simultaneously.

3. An automatic selection and delivery apparatus according to claim 2, in which the end of said first delivery arm has a roller or rollers rolling on said inclined surface when said bracket is advanced.

4. An automatic selection and delivery apparatus according to claim 2 or 3, in which a spring for biasing said first delivery arm in the direction opposite to the swinging direction thereof is disposed between said first delivery arm and said bracket.

5. An automatic selection and delivery apparatus according to claim 1, which further includes a second delivery arm driven radially of said base, whenever said base comes to a stop, along a recess different from that along which said first delivery arm is driven, the end of said second delivery arm having a configuration for engaging a projection which will also exist on an incorrectly assembled body.

6. An automatic selection and delivery apparatus according to claim 2 or 3, which further includes a second delivery arm pivotally secured to said bracket or to a second bracket so as to swing in a predetermined plane different from that in which said first delivery arm swings.

* * * * *